United States Patent [19]

Davidowich et al.

[11] 4,343,134

[45] Aug. 10, 1982

[54] FLUSHABLE TOWELETTE

[75] Inventors: George Davidowich, Dunellen; Gerald D. Miller, Belle Mead, both of N.J.

[73] Assignee: Air Products and Chemicals, Inc., Allentown, Pa.

[21] Appl. No.: 163,243

[22] Filed: Jun. 26, 1980

Related U.S. Application Data

[62] Division of Ser. No. 870,552, Jan. 18, 1978, Pat. No. 4,258,849.

[51] Int. Cl.[3] ..... B65B 5/04

[52] U.S. Cl. ..... 53/431; 53/474

[58] Field of Search ..... 206/812, 205, 210; 428/289, 290, 296; 53/428, 429, 431, 469, 474

[56] References Cited

U.S. PATENT DOCUMENTS

| | | | |
|---|---|---|---|
| 3,135,648 | 6/1964 | Hawkins | 260/29.6 BM X |
| 3,213,051 | 10/1965 | Pierce | 260/29.6 BM |
| 3,355,322 | 11/1967 | Worrall | 428/477.7 X |
| 3,438,808 | 4/1969 | Hawkins et al. | 525/62 X |
| 3,654,928 | 4/1972 | Duchane | 128/290 W |
| 3,881,210 | 5/1975 | Drach et al. | 206/812 X |
| 3,895,474 | 7/1975 | Bauer | 53/431 X |

*Primary Examiner*—John Sipos
*Assistant Examiner*—Charles L. Willis
*Attorney, Agent, or Firm*—Richard A. Dannells, Jr.; E. Eugene Innis

[57] ABSTRACT

Nonwoven fibrous sheets bonded with polyvinyl alcohol, intended for use in pre-moistened condition as skin cleansing tissues, are folded and packaged in closed containers or in individual sealed water impervious envelopes; said packaged sheets being maintained in contact with a dilute aqueous solution of boric acid. The boric acid imparts improved wet tensile strength to the sheet during storage and use by the consumer but may be safely disposed of, after use, by flushing in plain water without danger of clogging the plumbing system. Instead of boric acid solution, one may employ for the indicated purpose a non-alkaline aqueous solution of a salt which acts as a precipitating or gelling agent for polyvinyl alcohol, said salt being one having an acid to neutral pH on hydrolysis.

4 Claims, No Drawings

FLUSHABLE TOWELETTE

This is a division of application Ser. No. 870,552, filed Jan. 18, 1978, now U.S. Pat. No. 4,258,849, issued Mar. 31, 1981.

BACKGROUND OF THE INVENTION

1. Field of the Invention

This invention relates generally to disposable wet-packaged skin cleansing fabrics or cloths formed of paper or other nonwoven fibrous webs of the kinds generally known in the art as towelettes, wet-wipes, fem-wipes, and the like. It is particularly concerned with the provision of such fabrics which will retain suitable wet tensile strength during storage and use but which can be readily disposed of by flushing in water without danger of clogging the plumbing system.

2. Prior Art

Wet-packaged skin cleansing and refreshing tissues are well-known commercially, generally referred to as towelettes, wet-wipes, fem-wipes, and the like. Typical examples of such products are described in U.S. Pat. Nos. 3,057,467; 3,563,371; and 3,398,826. These may comprise an absorbent sheet made of paper, prepared or treated to impart wet strength thereto, having the dimensions of the usual wash cloth and packaged wet in folded condition individually in impervious envelopes or in multiples in closed containers. The liquid employed in pre-moistening the sheet is generally an aqueous alcoholic solution which may further contain a surface active detergent and a humectant and in some instances also a scenting agent. Instead of individual packaging of such moist sheets, these are often marketed in recloseable containers having any desired convenient number of such folded sheets. A typical example of such products particularly designed for use in feminine hygiene, popularly known as "fem-wipes", is disclosed in U.S. Pat. No. 2,999,265.

Certain of the earlier known products suffer from the drawbacks of loss of wet strength on account of being kept moist for even relatively short periods of storage, thereby interfering with their intended use by the consumer. Others of these known products which retain adequate wet strength, cannot be readily disposed of by flushing in water in conventional toilet bowls, since the binders employed in imparting wet strength do not disintegrate sufficiently and thus after cause clogging of the plumbing. In some instances, it has been advocated that acidic or alkaline materials respectively be added to the water empoyed in flushing the used cloths to assist in disintegrating the binder therein, these being selected in accordance with the nature of the resinous binder employed.

Polyvinyl alcohols (PVOH) are well-known in commerce for use in textile and paper sizing and coating, as adhesives, binding agents, dispersing/stabilizing agents for emulsions, and the like. These alcohols are generally manufactured by polymerizing vinyl acetate and hydrolyzing the acetate to an alcohol. The marketed grades of polyvinyl alcohol vary in degree of polymerization and degree of hydrolysis. As used herein, "fully hydrolyzed" products are those in which the vinyl acetate has been hydrolyzed to about 95% or higher and up to about 99% by weight. Polyvinyl alcohols having a degree of hydrolysis above 99% are designated as "super hydrolyzed". Films produced from polyvinyl alcohol grades having a degree of hydrolysis above about 95% are resistant to attack by cold water; the extent of water resistance increasing directly with increase in the degree of hydrolysis. Polyvinyl alcohols of lower degree of hydrolysis than the so-called fully hydrolyzed products, such as the "partially hydrolyzed" grades (80–95% by weight hydrolyzed) are almost completely soluble in water at room temperature, while the fully hydrolyzed products have more limited cold water solubility.

Changes in the degree of polymerization primarily affect solution viscosity; i.e. the viscosity of "fully hydrolyzed" and "partially hydrolyzed" products of low viscosity (in 4% aqueous solution at 20° C.) are about 10 cps, medium viscosity are in the range of about 20–35 cps and high viscosity are in the range of about 40 cps and above. The viscosity of the aqueous solution of the polyvinyl alcohol is thus an indication of the degree of polymerization.

Also available on the commercial market are the socalled "tackified" polyvinyl alcohols. These are produced by controlled boration of polyvinyl alcohol as disclosed, for example, in U.S. Pat. No. 3,135,648. According to the patent, the wet tack of polyvinyl alcohol adhesives is increased by addition thereto of about 4 to 15% of a water soluble boron compound and an amount of acid such that the pH of the adhesive is below 5.5. The desired high wet tack adhesives are prepared by cooking the mixture of polyvinyl alcohol and borate compound in water.

Surface sizing of paper with aqueous mixtures of polyvinyl alcohol and boric acid is disclosed in U.S. Pat. No. 3,438,808. The boric acid in admixture in the amount of 15% or more of the polyvinyl alcohol and applied in heated condition to the web, inhibits the extent of penetration or migration of the sizing composition into the paper.

Boron compounds such as boric acid and alkali metal borates, are known to react with polyvinyl alcohol. Whereas boric acid is believed to react with PVOH to form a reaction complex having monodiol type bond, which complex is not a gel; by reaction of PVOH with borax (or other alkali metal borate) complexes having didiol cross-linkages are formed which are of gel nature. It was concluded by R. F. Nickerson (J.A.P.P. Polymer Science: 15, 111; 1971) that the borate ion is the effective cross-linking agent and that boric acid at concentrations greater than 0.03 M contributes borate ions in sufficient amount to provide a gel type complex. Thus, the reaction mechanism in the case of borax and boric acid respectively may be represented by the equations below:

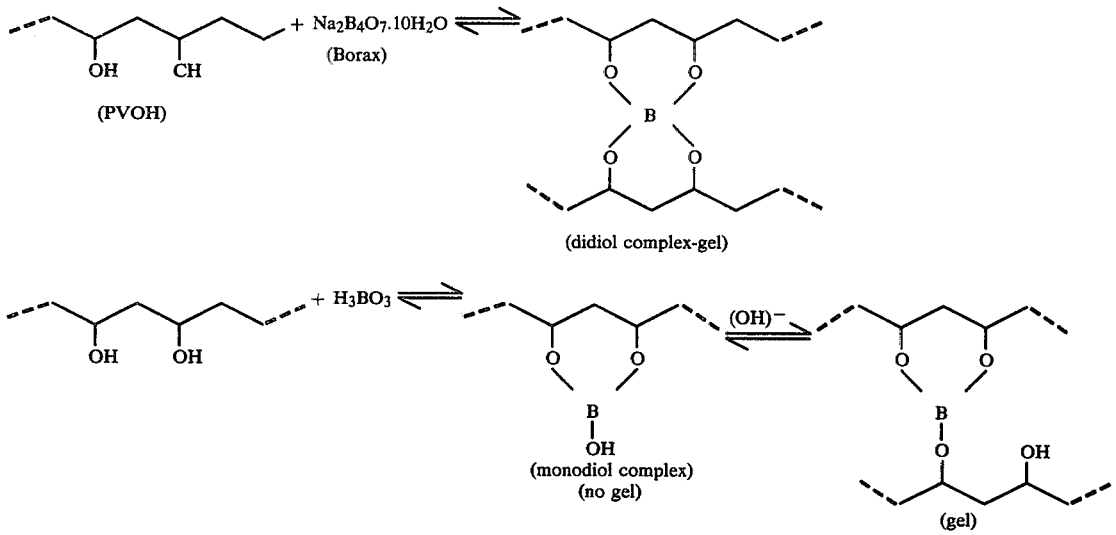

Coating and sizing composition containing polyvinyl alcohol and a borate or boric acid are known in various arts. Thus, U.S. Pat. No. 2,324,601 discloses sizing compositions for synthetic linear polyamide knitting yarns comprising water soluble polyvinyl alcohol and boric acid, said size being removable by hot water washing of the yarn. It is also known to post-treat polyvinyl alcohol spun fibers following coagulation with boric acid solution, as well as the incorporation of limited amounts of boric acid or bromates into the spinning solutions to improve hot water resistance, or other high temperatures properties of the formed PVOH fibers (U.S. Pat. Nos. 3,170,973 and 3,850,901).

It is also known to employ certain resins and other polymeric materials as binders or coatings or nonwoven fabrics used as toilet-flushable disposable products such as wrappers or outside coverings for diapers and sanitary napkins, surgical dressings and the like, wherein such fabrics need have during their intended use sufficient tensile strength not to disintegrate while in contact with body fluid discharges. Among binders suggested for use in such fabrics are aqueous dispersions of mixtures of acrylic resins and polyvinyl alcohol, as disclosed for example, in U.S. Pat. No. 3,561,447. The use of cold water soluble polyvinyl alcohol in the absence of other resins or polymers as such bonding agent for disposable nonwoven fabrics, is disclosed in U.S. Pat. No. 3,654,928. To prevent premature structural weakening or disintegration of the fabric as a result of softening or dissolution of the polyvinyl alcohol binder in the presence of body discharge fluids; the polyvinyl alcohol film is oversprayed with a gelling or insolubilizing agent such as borax, which is stated to react with the polyvinyl alcohol and cross-link at least the exposed surface areas to a sufficient degree to render the reacted binder, when dried, somewhat water resistant. When the treated fabric is exposed to a large excess of water, the borax is said to be cross-linkaged in the polymer to reduce water resistance to a non-effective level.

In a subsequent patent by the same inventor, U.S. Pat. No. 3,689,314, certain of the shortcomings and disadvantages of the borax treatment proposed in the earlier patent are set forth. The later patent advocates application to the fabric reactants which form borax in situ only on heating, to overcome the problem of premature gelation of the polyvinyl alcohol solution by direct addition of borax thereto. Thus, in accordance with this patent, the web is treated with a cold water solution of polyvinyl alcohol containing boric acid and sodium bicarbonate and the web dried at elevated temperature to effect the desired reaction. Further modifications set out in U.S. Pat. Nos. 3,692,725 and 3,808,165. These patents respectively disclose addition of carbon dioxide or an unstable organic acid releasing carbon dioxide, into the polyvinyl alcohol-borate binder composition, to overcome asserted previous shortcomings.

Since borax disassociates in water to give borate ion, it is considered a more sensitive PVOH gelling agent than boric acid. In the initial experimental work leading to the present invention, it was surprisingly found that whereas a film of partially hydrolyzed PVOH (low viscosity 87–89% hydrolyzed) which can be dissolved in water within one minute, also dissolved in a 5% borax solution, but did not dissolve in a 5% boric acid solution. This discovery led to further investigation resulting in the present invention.

SUMMARY OF THE INVENTION

The foregoing drawbacks of the prior art wet-packaged tissues are overcome by the products of the present invention wherein such wet-packaged cloths are made of nonwoven fibers coated or impregnated with polyvinyl alcohol binder to impart wet strength. The cloths are packaged in contact with an aqueous cleansing liquid containing a compound, such as boric acid, which serves to temporarily insolubilize the polyvinyl alcohol binder, thereby preserving adequate wet strength of the cloth during packaged wet storage and use of the cloth by the consumer, yet permitting safe disposition thereof, after use, by flushing in plain water without danger of clogging conventional plumbing equipment.

Among the objects of the present invention are to provide a pre-moistened towelette or skin cleansing wipes having sufficient wet tensile strength throughout its shelf life and during intended use by the consumer, and which after use may be safely disposed of by flushing in plain water without danger of clogging the plumbing system.

To attain such objectives, nonwoven fibrous webs are treated with an aqueous solution of polyvinyl alcohol and dried to form a surface coating. Sheets of such coated web of suitable desired size for use as disposable wet skin cleansing tissues, are folded and packaged while wet in contact with an aqueous solution of boric acid in a concentration up to the limits of its solubility or with an aqueous solution of a soluble salt having an acid to neutral pH on hydrolysis and in a concentration of up to about 20 percent by weight.

DETAILED DESCRIPTION

The initial treatment to coat or impregnate the nonwoven fabric, such as absorbent paper, with the polyvinyl alcohol may be carried out by immersing webs or running lengths of the fabric in an aqueous solution of the polyvinyl alcohol or by applying such solution to the surfaces of the web by spraying, by padding, by roller or other type of applicator. Following drying, the treated web may then be cut to desired size sheets for the intended use. If desired, of course, individual sheets pre-cut to desired size may be treated with the aqueous polyvinyl alcohol solution.

It is preferred to employ for the treatment polyvinyl alcohol that is readily soluble in cold water, such as a partially hydrolyzed PVOH, and one which has a low to medium viscosity; although other grades might be employed under suitable conditions provided these are at least sufficiently swellable if not soluble in water at ambient temperature and within a reasonable time period. For example, in the latter category, there may be employed a polyvinyl alcohol of fully hydrolyzed grade but having a low viscosity (as about 5–7 cps). Viscosity, as herein referred to, is that determined for a 4% aqueous solution at 20° C., unless otherwise indicated.

The polyvinyl alcohol solution employed may contain 1 to 35% by weight of PVOH, preferably 3 to 15%. Such solutions should best be applied under conditions to effect a pickup of 5 to 50% by weight of the fabric on a dry basis.

The nonwoven fabric web may be of any of the types heretofore employed for disposable towelettes or wipes such as those comprising carded or randomly oriented or cross-laid fibers. The fibers may be of natural or regenerated cellulose, other synthetic or proteinaceous fibers of biodegradable materials, or mixtures of these.

The finished towelettes or wipes of desired dimensions may be individually packaged, preferably in folded condition, in moisture proof envelopes or in containers holding any desired number of such folded sheets. For individual packaging, it will be convenient to wet the folded sheet with the boric acid solution prior to inserting the same into the envelope, or the liquid may be injected into the open envelope which is thereafter sealed. If a number of the wet sheets are to be packaged in a single container which can be closed and reopened for removal of individual towelettes or wipes as needed, the folded sheets may either be pre-moistened with the boric acid solution or such solution may be poured over the stacked sheets in the container under conditions assuring appropriate wetting of each of the individual sheets therein. Preferably, the concentration of the boric acid solution is at least 3% by weight up to the limits of its solubility in water. More preferrably, the boric acid concentration is in the range of about 4 to 5% by weight, with 5% being the solubility limit of boric acid at room temperature.

Various forms of impermeable envelopes for containing wet-packaged materials such as towelettes, wiping and polishing cloths and the like are well-known in the art. Any of these may be employed in packaging the wetted towelettes of the present invention. The envelopes for individual packaging may be formed of any material impervious to the liquid contents and not adversely affected thereby. Thus, the envelopes may be made of plastic materials or of cellulosic materials lined or coated with plastic or other waterproof compositions. Preferably, the envelope should be of a type that can be conveniently opened by tearing to remove the packaged wet towelette.

The following examples are illustrative of various features of articles of this invention and their method of preparation. Unless otherwise indicated in these examples percent refers to weight percent.

EXAMPLE 1

A 24 pound (25×38 inch—500 ream) (10.9 kg—27.7×96.5 cm) high groundwood, unsized paper substrate was impregnated with a solution of VINOL TM 205 PVOH to the extent of 4 pounds (1.81 kg) dry add-on and dried in a 120° C. forced air oven. On test, the dried sheet after immersion in water for two minutes, was found to have a tensile strength of 0.59 pounds (about 0.27 kg), substantially the same as that of the base stock (untreated with PVOH) immersed in water for two minutes. However, when immersed in 5% boric acid solution for two minutes, the wet tensile strength jumped nearly 3-fold—to about 1.6 pounds (about 0.73 kg).

VINOL 205 is a partially hydrolyzed PVOH grade (87–89% hydrolyzed) of low viscosity (4–6 cps) marketed by Air Products and Chemicals, Inc.

To study the effect of the temperature of the boric acid solution on the solubility of a PVOH film, the following experiment was conducted.

EXAMPLE 2

Films of 15 mil (0.038 cm) wet thickness were separately cast from VINOL 205 and VINOL 540 PVOH and dried at room temperature. Strips of 1×6 inches (about 2.54×15.24 cms) were then immersed in a 5% boric acid solution at selected temperatures to determine film stability and shelf life at the elevated temperatures that may be experienced under storage conditions. The results are reported in Table 1.

TABLE 1

| | 80° F. (26.7° C.) | 130° F. (54.4° C.) | 160° F. (71.1° C.) |
|---|---|---|---|
| VINOL 205 | 300 days | 30 days | 16 hours |
| VINOL 540 | 300 days | 30 days | 3 days |

The VINOL 205 strip stored in 5% boric acid solution at ambient temperature for one year showed no observable change in tensile strength as determined by finger pull.

VINOL 540 is a high viscosity (40–50 cps) partially hydrolyzed PVOH (87–89% hydrolyzed) marketed by Air Products and Chemicals, Inc.

80% hydrolyzed PVOH is commonly known to have reverse solubility, i.e. insoluble in water at temperatures above 20° C., but soluble at room temperature. For this reason a treated film from such a grade would tend to have an even greater shelf life than the films exemplified above prepared from PVOH which had been hydrolyzed to higher than about 80%.

EXAMPLE 3

To determine flushability characteristics, some of the dried paper sheets which were treated with PVOH as in Example 1 above, were immersed in 5% boric acid solution for two minutes followed by immersion in plain water for two minutes. The wet tensile strength was then determined by the Instron Method.

There was a desirable rapid drop in the wet tensile strength of the boric acid pretreated sheet upon two minute reimmersion in plain water, from an initial wet tensile strength of about 1.6 pounds (0.73 kg) to less than half of that value.

This was compared to a commercial test-marketed product comprising paper wipes impregnated with an alkali sensitive acrylic polymer. The commercial product tested before and after water immersion, showed only a slight decrease in wet tensile strength after 16 hours immersion in water.

EXAMPLE 4

A high groundwood stock paper substrate (24 pound/3300 ft.$^2$=10.9 kg/307 sq. meters) was treated with a 15% aqueous solution of VINOL 205 PVOH applied with a #10 Mayer rod separately to each side of the paper and dried dat 250° F. (~120° C.) for 30 seconds. The coated first side was dried before applying the coating to the other side.

The dried paper was then immersed for two minutes in 5% boric acid solution and its wet tensile strength determined by Instron (C) and compared with that of the base stock (A) and the coated sheet without boric acid (B). The results are reported in Table 2 below. The resolubility was demonstrated by further immersion of the boric acid treated sheet in plain water for two minutes (D).

TABLE 2

| | | Instron Wet Strength (pounds/kgs.) |
|---|---|---|
| A. | Base stock untreated | 0.55/0.25 |
| B. | Treated with PVOH | 0.59/0.27 |
| C. | Treated with PVOH, then boric acid | 1.73/0.785 |
| D. | Reimmersion in water after C. | 0.70/0.32 |

EXAMPLE 5

Further studies were carried out to determine the effect of boric acid concentration on the wet tensile strength of PVOH impregnated papers. These studies were made on paper sheets of a 42 pound/3300 sq. ft. stock (19 kg/307 sq. meters) each respectively immersed in boric acid solution of successively increasing concentrations. It was found that the wet tensile strength increased almost linearly with concentration from 0.72 pounds (~0.33 kg) at zero boric acid through 1.41 pounds (~0.64 kg) at 5% boric acid.

EXAMPLE 6

Papers treated with other grades of polyvinyl alcohol were tested to determine the effect of boric acid in inhibiting disintegration. These included commercial grades identified as:

| | % Hydrolysis | Viscosity (cps) |
|---|---|---|
| VINOL 540 | 87–90 | 40–50 |
| VINOL 605 | 80 | 4.4–5.2 |
| VINOL 650 | 80 | 40–60 |
| VINOL 107 | 98–98.8 | 5–7 |

Each of these VINOL compositions were applied to a 24 lb./3300 ft.$^2$ (10.9 kg./307 sq. meters) base stock and dried at 250° F. (120° C.) for 30–90 seconds, as required. The amount of PVOH add-on varied due to viscosity differences so that the measured wet tensile values are not directly relatable between the grades.

All of these PVOH treated sheets exhibited wet tensile improvement with 5% boric acid immersion versus water immersion and all showed resolubility in plain water after short immersion in boric acid solution, as shown in Table 3.

TABLE 3

| | | Wet Strength (lbs.) | | |
|---|---|---|---|---|
| | % Add on | Water | Boric Acid | Boric Acid, then water |
| VINOL 205 | 17 | 0.60 | 1.73 | 0.72 |
| VINOL 540 | 31 | 0.90 | 2.0 | 1.72 |
| VINOL 605 | 11 | 0.64 | 1.56 | 0.68 |
| VINOL 650 | 27 | 0.80 | 2.0 | 0.78 |
| VINOL 107 | — | 1.27 | 2.0 | 1.40 |

EXAMPLE 7

The water soluble salts listed in the table below have acid to neutral pH on hydrolysis and are believed to be suitable substitutes in place of boric acid, which is also listed for comparison, at concentrations of up to 20% by weight in the articles of this invention. Table 4 below shows the minimum concentration causing precipitation of the compound dissolved in a 5% solution of polyvinyl alcohol (98–99% hydrolyzed, degree of polymerization 1700–1800).

TABLE 4*

| Compound | Minimum concentration for salting out (g/l) |
|---|---|
| $(NH_4)_2SO_4$ | 66 |
| $Na_2SO_4$ | 50 |
| $K_2SO_4$ | 61 |
| $FeSO_4$ | 105 |
| $MgSO_4$ | 60 |
| $Al_2(SO_4)_3$ | 57 |
| $KAl(SO_4)_2$ | 58 |
| Potassium citrate | 38 |
| $H_3BO_3$ | 16.5 |

*Data on the soluble salts of Table 4 were taken from Finch, C.A., POLYVINYL ALCOHOL, 1973; John Wiley & Sons, Ltd., Table 2.3 at page 40.

EXAMPLE 8

Cast films of VINOL 205 PVOH (1"×6"=2.5×15.24 cm) were separately tested to determine solubility respectively in boric acid solutions and in sodium sulfate solutions at different concentrations. The results are reported in Table 5.

TABLE 5

| Solute g/100 cc water | Film Description |
|---|---|
| Sodium Sulfate | |
| 5 | Soluble; 30 seconds. |
| 10 | Slimy. |

TABLE 5-continued

| Solute g/100 cc water | Film Description |
|---|---|
| 15 | Slimy. |
| 20 | Insoluble; transparent film. |
| 30 | Insoluble; transparent film. |
| Boric Acid | |
| 1 | Soluble; 2 minutes. |
| 3 | Stringy. |
| 5 | Insoluble; turned white opaque in 2 minutes. |

From the foregoing tests it appears that while the soluble salts listed in Table 4 above, such as sodium sulfate, can be employed to retard solubilizaion of polyvinyl alcohol films, greater concentrations, i.e. about 7 to about 20%, are required than when using boric acid.

As projected from the data set forth in Tables 4 and 5, potassium citrate appears to be even more efficient than sodium sulfate in the articles of this invention.

The specific behaviour of boric acid in retaining solubilization of PVOH film is not attributable to the pH of the boric acid solution. Whereas a VINOL 205 film was insoluble in 5% boric acid solution, such film was readily dissolved respectively, in 5% aqueous solutions of citric and phosphoric acid and a 0.7% solution of fumaric acid.

The unexpected differences in the behaviour of borax versus boric acid also cannot be explained on the basis of difference in pH. Having found that Vinol 205 film dissolved in a 5% borax solution but was insoluble in 5% boric acid solution, experiments were conducted in attempt to determine the mechanism. Solutions of each of these compounds were tested with pH adjustment on Vinol 205 film. A 5% boric acid solution was prepared which had an as is pH of 4.0. Portions thereof were adjusted with phosphoric acid to lower pH and with sodium hydroxide to higher pH at the values indicated in Table 6. Borax was dissolved in water to a 5% solids concentration which had an as is pH of 9.1 and incrementally adjusted down to indicated pH with phosphoric acid. As shown in Table 6, the polyvinyl alcohol film immersed in either of these borate-containing solutions dissolved more readily at pH above 7. However, at pH below 7, the films immersed in boric acid were rubbery to elastic whereas those immersed in borax solution were stretchable to nearly arms length.

TABLE 6

| pH | 5% Boric Acid Solution | 5% Borax Solution |
|---|---|---|
| 2.0 | white opaque; elastic | elongation; stretchable |
| 3.0 | white opaque; elastic | elongation; stretchable |
| 4.0 | white opaque; elastic | elongation; stretchable |
| 5.0 | partly cloudy; elastic | elongation; stretchable |
| 6 | partly cloudy; elastic | elongation; stretchable |
| 7 | 80% dissolved | partly cloudy |
| 8 | 90% dissolved | transparent film |
| 9 | soluble | 90% dissolved |

TABLE 6-continued

| pH | 5% Boric Acid Solution | 5% Borax Solution |
|---|---|---|
| 10 | soluble | — |

Specific modes of preparing the packaged towelettes of the present invention have been described above. It is contemplated that other ingredients commonly found in towelettes of the prior art can be included in the package of this invention without departing from its spirit. Such ingredients include a humectant such as propylene glycol, skin protecting agents such as allantoin or resorcinol and a variety of perfumes and other scenting agents. All such variations that fall within the scope of the appended claims are intended to be embraced thereby.

What is claimed:

1. A method of preparing a packaged towelette having enhanced wet strength while maintained in wet condition in a sealed container package and while during use until flushed in water, comprising:

(a) forming a polyvinyl alcohol binder in a web of nonwoven fibers to form a polyvinyl alcohol impregnated towelette, wherein said polyvinyl alcohol binder consists of enhanced flushability polyvinyl alcohol having a degree of hydrolysis of from 80–95%;

(b) packaging said impregnated towelette in an impervious closed container; and (c) maintaining said polyvinyl alcohol binder in a gel-like form in a wet condition in said container by contact with a non-alkaline aqueous solution of boric acid having a concentration of at least 3% by weight up to its limit of solubility, thereby temporarily insolubilizing said polyvinyl alcohol binder until flushed in water.

2. A method of preparing a packaged towelette having enhanced wet strength while maintained in wet condition in a sealed container package and while during use until flushed in water, comprising:

(a) forming a polyvinyl alcohol binder in a web of nonwoven fibers to form a polyvinyl alcohol impregnated towelette, wherein said polyvinyl alcohol binder consists of enhanced flushability polyvinyl alcohol having a degree of hydrolysis of from 80–95%;

(b) packaging said impregnated towelette in an impervious closed container; and (c) maintaining said polyvinyl alcohol binder in a gel-like form in a wet condition in said container by contact with a non-alkaline aqueous solution of a soluble salt selected from the group consisting of sodium sulfate and potassium citrate, said soluble salt solution having a concentration of at least 3% by weight, thereby temporarily insolubilizing said polyvinyl alcohol binder until flushed in water.

3. A method according to claim 2 wherein said solution of soluble salt consists essentially of sodium sulfate at a concentration of 7–20% by weight.

4. A method according to claim 1 or 3 wherein said polyvinyl alcohol binder has a low to medium viscosity.

* * * * *

UNITED STATES PATENT AND TRADEMARK OFFICE

CERTIFICATE OF CORRECTION

PATENT NO. : 4,343,134

DATED : August 10, 1982

INVENTOR(S) : Gerald D. Miller

It is certified that error appears in the above-identified patent and that said Letters Patent are hereby corrected as shown below:

Cover Page

Delete "George Davidowich" as inventor

Signed and Sealed this

*Twenty-sixth* Day of *October 1982*

[SEAL]

*Attest:*

GERALD J. MOSSINGHOFF

*Attesting Officer*

*Commissioner of Patents and Trademarks*